United States Patent [19]

Nakanishi et al.

[11] Patent Number: 4,565,306

[45] Date of Patent: Jan. 21, 1986

[54] CREAM-STATE FLUID CONTAINER

[75] Inventors: Kenichi Nakanishi, Minami-ashigara; Hideo Ogita, Hachioji; Tadao Saito, Tokyo; Riichi Ogawa, Matsudo, all of Japan

[73] Assignee: Yoshino Kogyosho Co., Ltd., Tokyo, Japan

[21] Appl. No.: 568,120

[22] Filed: Jan. 4, 1984

[30] Foreign Application Priority Data

Jan. 18, 1983 [JP] Japan ..... 58-5841[U]

[51] Int. Cl.[4] ..... B67D 5/40

[52] U.S. Cl. ..... 222/383; 222/389; 222/401

[58] Field of Search ..... 222/563, 401, 402, 327, 222/388, 389, 383, 386, 386.5, 385, 207, 209, 206

[56] References Cited

U.S. PATENT DOCUMENTS 3,252,447 5/1966 Ramer ..... 222/383
3,726,442 4/1973 Davidson et al. ..... 222/207
3,910,458 10/1975 Ewald ..... 222/383
4,300,705 11/1981 Shy ..... 222/383
4,402,431 9/1983 Wiegner et al. ..... 222/563

*Primary Examiner*—F. J. Bartuska
*Assistant Examiner*—Kenneth Noland
*Attorney, Agent, or Firm*—Parkhurst & Oliff

[57] ABSTRACT

A cream-state fluid container having a body capable of being reduced in interior volume by evacuating the interior thereof in negative pressure, a head mounted at the top of the body and having a pushbutton and a filling port, a pump unit internally mounted in the head and operated by the pushbutton of the head for discharging the content of the body to the filling port of the head, the pump unit having a valve mechanism including a suction valve and a discharge valve in such a manner that a valve body is seated on a cylindrical valve seat formed in the head, a pressure chamber formed in a space from the valve mechanism at the position above the valve mechanism, and an elastic cap capable of being elastically deformed by depressing the cap by the pushbutton. Thus, the wasteful loss of cream-state liquid can be eliminated in discharging the liquid from the container.

11 Claims, 4 Drawing Figures

CREAM-STATE FLUID CONTAINER

BACKGROUND OF THE INVENTION

This invention relates to a cream-state fluid container.

Various types of cream-state fluid containers are known so as to readily discharge cream-state fluid contained in a container. However, any of these containers does not rapidly discharge the cream-state fluid or substance upon depressing of a head of the container, but delay to exhaust cream-state heavily viscous material from depression of the head. Further, more than necessary amount of cream is wastefully discharged inconveniently by the depression of the head due to its heavy viscosity and delay in spray-like exhaust under the excessive pressure produced in the container upon depressing of the head of spraying type, and frequently wasted as loss.

SUMMARY OF THE INVENTION

Accordingly, an object of the present invention is to provide a cream-state fluid container which can eliminate all the aforementioned drawbacks and disadvantages of the conventional cream-state liquid container and which can readily and effectively operate and discharge the cream-state fluid without loss of wasteful cream-state fluid.

BRIEF DESCRIPTION OF THE DRAWINGS

The above and other related objects and features of the invention will be apparent from a reading of the following description of the disclosure found in the accompanying drawings and the novelty thereof pointed out in the appended claims.

DESCRIPTION OF THE PREFERRED EMBODIMENTS

The present invention will now be described in more detail with reference to the accompanying drawings.

Figure 1:
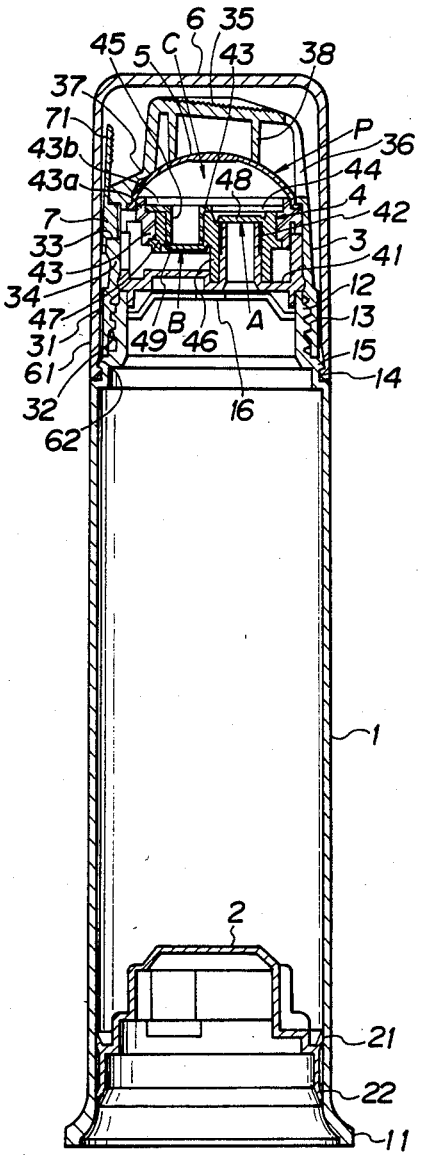
FIG. 1 is a longitudinal side sectional view of an embodiment of a cream-state fluid container constructed according to the present invention with a head cover removed.
Figure 2:
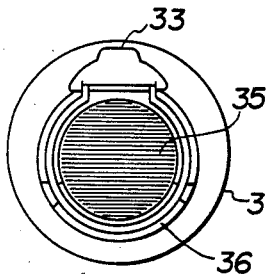
FIG. 2 is a plan view of the essential part of the cream-state fluid container with the head cover removed.
Figure 3:
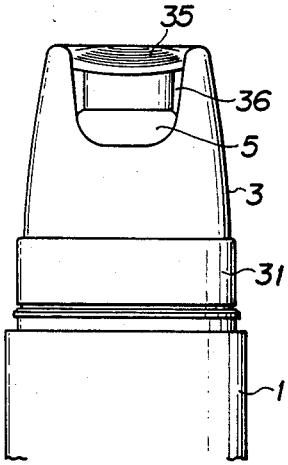
FIG. 3 is a back view of the fluid container with the head cover removed.
Figure 4:
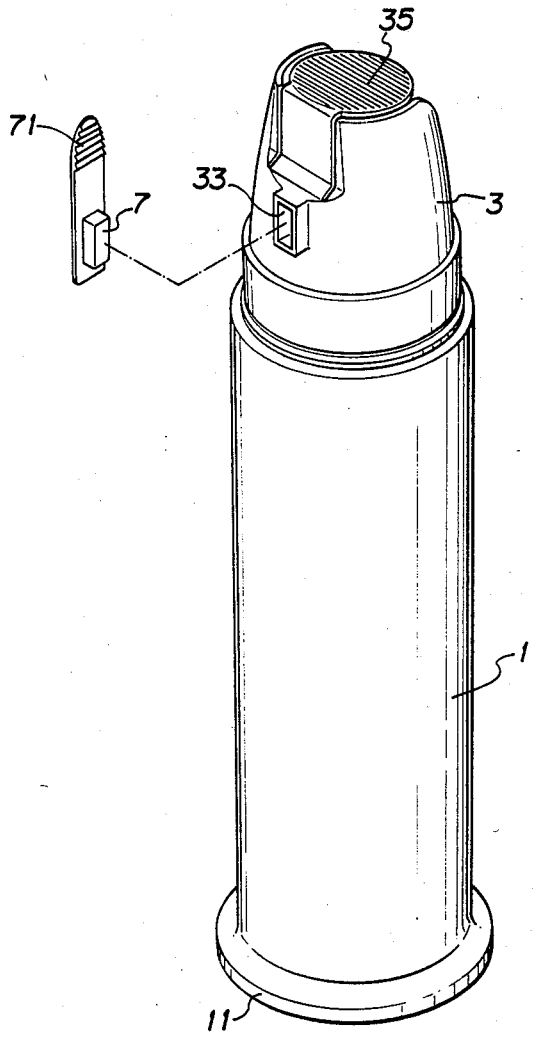
FIG. 4 is a perspective view of the cream-state fluid container with the head cover removed.

In FIGS. 1–3, reference numeral 1 designates a cylindrical body, numeral 2 designates an elevationally movable bottom elevationally movably engaged within the body 1, numeral 3 designates a head threaded to the top of the body, numerals 4 and 5 designate a valve mechanism and an elastic cap forming a pump unit P in the head 3, numeral 6 designates a head cover detachably covered on the outside of the head 3, and numeral 7 designates a plug of the head 3, all of which are formed of synthetic resin.

The body 1 is formed in an erecting cylindrical shape, opened at the lower end to form a leg portion 11, formed at the outer periphery of the minimum-diameter portion 12 of the top thereof with outer threads 13 on the peripheral portion thereof, formed at the upper edge of the middle-diameter portion 14 thereof with inner engaging threads 15 on the inner periphery and formed at the inside of the minimum-diameter portion 12 thereof with a valve mechanism seat 16 of plate shape crossing the inside of the minimum-diameter portion 12.

The bottom 2 is swelled down at the center portion thereof upwardly in three steps corresponding to the shape of the top of the body 1, circumferentially formed at the lower outer periphery thereof with upward and downward skirts 21 and 22 on the lower outer periphery thereof, thereby watertightly and slidably engaging itself within the body 1.

The head 3 is formed in a hollow cap shape, formed circumferentially on the inner periphery of the lower end 31 thereof with inner threads 32 engaged with the upper minimum-diameter portion 12 of the body 1, opened at the front surface of a peripheral wall 34 with a filling port 33, and formed at the top wall thereof with a lever-shaped pushbutton 35. The pushbutton 35 is formed at the upper end of the wall 34 in such a manner substantially retarded at the front portion thereof, opened at the rear portion thereof with a window hole 36, notched from the front portion thereof to the top wall 35 to connect at the front end thereof to the lower portion of the wall 34 in the pushbutton, formed at the front end thereof in a thin shape with a hinge 37 and formed to be downwardly movably by depressing with the hinge. Further, the pushbutton is formed downwardly at the inner surface thereof with a pressing piece 38 for depressing the cap 5.

The valve mechanism 4 has a suction valve A and a discharge valve B formed therein. The cap 5 form a pressure chamber C. Thus, in the head 3, the pump unit P which communicates at both sides thereof with the port 33 in the body 1.

The valve mechanism 4 has a dish-shaped lower base plate 41 engaged fixedly with the peripheral wall 34 of the head 3 from the minimum-diameter portion 12 of the body 1 in the head 3, a cylindrical valve seat 42 erected to communicated with the body 1 at the rear part of the base plate 41, an upper base plate 43 arranged in engagement with a frame **43*a* and a plate 43*b* on the base plate 41 in such a manner that the frame 43*a* is engaged with the wall 34 in the head 3 and the plate 43*b* is perforated with a through hole 44 formed corresponding to the valve seat 42 of the base plate 41 at the rear part thereof, and another cylindrical valve seat 45 having a size of substantially ½ of the valve seat 42 in the length in communication with the upper part thereof at the front part thereof for supporting the base 47 of a valve body 46 formed of a soft synthetic resin (or rubber) with the base plates 41 and 43 so that the base 47 has two small cylinders aligned in parallel with each other and engaged with the outer peripheries of the valve seats 43 and 45 as well as valves 48 and 49 are respectively disposed on the seats 42 and 45 in the shape of cantilever at the end faces of the seats 42 and 45 and that a suction valve A is formed at one side and a discharge valve B is formed at the other, and a space formed between the base plates 41 and 43 is formed to communicate as a discharge passage with the port 33**.

The elastic cap 5 is formed in a semispherical shape of soft synthetic resin (or rubber), interposed at the peripheral edge between the base plate 43 of the balve mechanism 4 and the inner surface of the peripheral wall 34 of the head 3, and contacted at the top with the lower surface of the pressing piece 38 of the pushbutton 35, thereby forming therein a pressure chamber C.

The head cover 6 is detachably engaged at the lower end of the peripheral wall 61 thereof to the middle-diameter portion 14 of the body 1, and formed circumferentially at the inner periphery of the lower end thereof with a recess groove 62 engaged with the threads 15 of the middle-diameter portion 14 thereof.

The plug 7 is detachably engaged with the port 33 of the head 3, and formed partly with a plug piece 71 projected therefrom.

In operation of the cream-state fluid container thus constructed as described above, the container is used by containing cream-state fluid or liquid in the body 1. When the content such as cream-state fluid or liquid is filled in the body, the head cover 6 is first removed, the plug 7 is then removed, and the pushbutton 35 of the head 3 is longitudinally fluctuated up and down by depressing and releasing the pushbutton 35.

Thus, the cap 5 is elastically deformed and recovered to the original shape, thereby varying the volume of the pressure chamber C. Then, the suction valve A and the discharge valve B are opened and closed correspondingly, thereby operating the pump unit P. In this manner, the content in the body 1 is injected through the pump unit P from the port 33.

Further, when the content of the body 1 is reduced in volume in this manner, the bottom 2 moves upwardly in the volume corresponding to the reduced volume of the content in the body 1.

According to the present invention as described above, the pump unit P is operated by the pushbutton 35. Thus, a predetermined volume of the content can be discharged upon depressing of the pushbutton in a manner extremely readily and lightly in discharging the content in the body.

Further, the valve is seated on the cylindrical valve seat in the suction valve A and the discharge valve B of the valve mechanism 4. Therefore, the responding speed of discharging the content in the body is accelerated correspondingly upon depressing of the pushbutton, thereby effectively discharging the content in the body without wasteful loss in high efficiency conveniently in practical use.

What is claimed is:

1. A cream-state fluid container comprising:

a body capable of being reduced in interior volume by evacuating the interior thereof in negative pressure, a head mounted at the top of said body and having a pushbutton and a filling port, a pump unit internally mounted in said head and operated by the pushbutton of said head for discharging the content of said body to the filling port of said head, said pump unit having a valve mechanism including a suction valve and a discharge valve in such a manner that a valve body is seated on a cylindrical valve seat formed in said head, a pressure chamber formed in a space from said valve mechanism at the position above said valve mechanism, and an elastic cap capable of being elastically deformed by depressing said cap by said pushbutton, said valve mechanism further comprising a dish-shaped lower base plate engaged fixedly with the peripheral wall of said head from the mimimum-diameter portion of said body, a cylindrical valve seat erected to communicated with said body at the rear part of the base plate, an upper base plate arranged in engagement with a frame and a plate member on the base plate in such a manner that the frame is engaged with the peripheral wall in said head and the plate member is perforated with a through hole formed corresponding to the valve seat of the base plate at the rear part thereof, and another cylindrical valve seat having a size of substantially ½ of the valve seat in the length in communication with the upper part thereof at the front part thereof and depending downwardly at the front part thereof for supporting the base of a valve body formed of a soft synthetic resin (or rubber) with the both base plates wherein the former base has two small cylinders aligned in parallel with each other and engaged with the outer peripheries of the both valve seats as well as both valves are respectively disposed on the both seats in the shape of cantilever at the end faces of the both seats and wherein a suction valve is formed at one side and a discharge valve is formed at the other, and a space formed between the base plates is formed to communicate as a discharge passage with the port.

2. The cream-state fluid container according to claim 1, wherein said body is reduced in three steps in diameter at the top thereof and formed with a valve mechanism seat of plate shape crossing the inside of the upper minimum-diameter portion thereof.

3. The cream-state fluid container according to claim 1, wherein an elevationally movable bottom member is arranged at the lower end of said body, said bottom member is swelled down in three steps upwardly at the center thereof in the shape corresponding to the top of said body, formed circumferentially with upward and downward skirts at the lower periphery thereof and fluidtightly and slidably engaged via said skirts within said body.

4. The cream-state fluid container according to claim 1, wherein said head is engaged with the outer periphery of the upper end minimum-diameter portion of said body.

5. The cream-state fluid container according to claim 1, wherein said filling port is formed with an opening at the front surface of the peripheral wall of said head.

6. The cream-state fluid container according to claim 1, wherein said pushbutton is substantailly retarded at the upper end of the peripheral wall thereof, opened with window hole at the rear thereof, and notched from the front part thereof to the top wall to communicated at the front end thereof with the lower part of the peripheral wall thereof.

7. The cream-state fluid container according to claim 1, wherein said pushbutton is formed in hinge shape in a thin shape at the front end thereof, and capable of being downwardly slidably moved by said hinge.

8. The cream-state fluid container according to claim 1, wherein said pushbutton is depended with a pressing piece for depressing said cap on the inner surface thereof.

9. The cream-state fluid container according to claim 1, wherein said elastic cap is formed in a semispherical shape of soft synthetic resin (or rubber), interposed at the peripheral edge between the base plate of the valve mechanism and the inner surface of the peripheral wall of said head, and contacted at the top with the lower surface of the pressing piece of said pushbutton, thereby forming therein a pressure chamber.

10. The cream-state sluid container according to claim 1, wherein said body is detachably engaged at the upper middle-diameter portion thereof with a head cover.

11. The cream-state fluid container according to claim 1, wherein said filling port is engaged removably with a plug, and projected with a plug piece at the part thereof.

* * * * *